US005972557A

United States Patent [19]

Sasaki et al.

[11] Patent Number: 5,972,557

[45] Date of Patent: Oct. 26, 1999

[54] PHOTOGRAPHIC ELEMENTS HAVING TEMPORARY BARRIER LAYER

[75] Inventors: Hiroki Sasaki; Hidetoshi Watanabe; Tetsuya Asakura, all of Kanagawa, Japan

[73] Assignee: Fuji Photo Film Co., Ltd., Minami-Ashigara, Japan

[21] Appl. No.: 09/093,722

[22] Filed: Jun. 9, 1998

[30] Foreign Application Priority Data

Jun. 10, 1997 [JP] Japan ..... 9-152713

[51] Int. Cl.[6] ..... G03C 8/54

[52] U.S. Cl. ..... 430/215; 430/216; 430/536

[58] Field of Search ..... 430/215, 216, 430/536

[56] References Cited

U.S. PATENT DOCUMENTS

| | | | |
|---|---|---|---|
| 3,847,615 | 11/1974 | Yoshida et al. | 430/215 |
| 4,267,262 | 5/1981 | Katino et al. | 430/215 |
| 4,440,848 | 4/1984 | Bailey et al. | 430/215 |
| 4,629,677 | 12/1986 | Katoh | 430/215 |
| 5,591,560 | 1/1997 | Fehervari et al. | 430/215 |

FOREIGN PATENT DOCUMENTS

| | | |
|---|---|---|
| 56-102852 | 8/1981 | Japan . |
| 56-97346 | 8/1981 | Japan . |
| 59-202463 | 11/1984 | Japan . |

*Primary Examiner*—Richard L. Schilling
*Attorney, Agent, or Firm*—Burns, Doane, Swecker & Mathis, LLP

[57] ABSTRACT

A photographic element which comprises at least one temporary barrier layer formed by applying an organic solvent solution containing at least two kinds of copolymers, wherein each of said at least two kinds of copolymers comprises, as its constituents, at least one monomer selected from group A, at least one monomer selected from group B, and at least one monomer selected from group C:

group A: mono(meth)acrylates of polyhydric alcohols;

group B: ethylenic unsaturated monomers having a carboxyl group; and group C: ethylenic unsaturated monomers which are other than those of groups A and B, and which are copolymerizable with the monomers of groups A and B.

4 Claims, No Drawings

PHOTOGRAPHIC ELEMENTS HAVING TEMPORARY BARRIER LAYER

FIELD OF THE INVENTION

This invention relates to photographic elements. More particularly, it relates to photographic elements having a temporary barrier layer against the diffusion (permeation) of an alkaline processing composition into photographic layers characterized in that the temporary barrier layer is formed by applying an organic solvent solution of a mixture comprising at least two kinds of copolymers.

More particularly, the present invention relates to photographic elements for a diffusion transfer process having improved storage stability with time and improved adhesion resistance between sheets (e.g., photosensitive sheet, image receiving sheet, cover sheet, etc.) for sandwiching an alkali processing composition development layer prior to the development of the alkali processing composition.

BACKGROUND OF THE INVENTION

It is a well known technique in the field of usual photography and diffusion transfer photography to provide a temporary barrier layer between layers of a photographic element into which a processing composition permeates.

In the diffusion transfer photography process, in particular, it has been a practice to use a neutralization layer in order to, for example, cease the development or stabilize the image. For preventing too early neutralization of the developing solution and the decrease in maximum density resulting therefrom which may cause by the use of the neutralization layer, it is also widely known to provide a temporary barrier layer as a mechanism for controlling the neutralization timing (i.e., as a timing layer).

In general, the reaction for developing silver halide photographs proceeds quickly at a high temperature but slowly at a low temperature. When the diffusion transfer process is to be applied to instant photography wherein the development is performed not under temperature control but at various temperatures different from the conventional photography, it is therefore highly important that photographic elements are capable of compensating temperature so that the developing solution is neutralized within a short period of time at a high temperature at which the development proceeds quickly but the neutralization is slowly carried out at a low temperature at which the development proceeds slowly, thus giving good images regardless of changes in the development temperature.

As examples of these timing layers capable of compensating temperature, U.S. Pat. No. 3,856,522 proposes to use butyl acrylate/diacetone acrylamide/styrene/methyl methacrylate copolymers; U.S. Pat. No. 4,061,496 proposes to use acrylonitrile/vinylidene chloride/acrylic acid copolymers; and JP-A-53-7266 discloses to use styrene/butyl acrylate/acrylic acid copolymers (the term "JP-A" as used herein means an "unexamined published Japanese patent application").

Although the timing layers described in these patents are excellent in the capability of compensating temperature of the neutralization reaction of developing solutions, they suffer from various problems. One of these problems resides in that since these timing layers are made of latex polymer materials, they should be dried at a high temperature under strictly controlled conditions (temperature, humidity, time, etc.), after the application, to give good coating films. Accordingly, complicated application/drying apparatuses are needed, which results in an increase in the cost in many cases. Moreover, the timing layer thus applied frequently undergoes aggregation which lowers the transparency of the film. Furthermore, there arise other troubles such that the timing layer frequently has only a low film strength, the timing layer is frequently peeled off due to poor adhesion thereof to the lower layer, etc.

To solve these problems, attempts have been made to form timing layers by applying polymer solutions in organic solvents. According to JP-A-56-97346, for example, a vinylidene/methyl acrylate/itaconic acid copolymer latex is once powdered and then dissolved in an organic solvent followed by application. Further, U.S. Pat. No. 4,440,848 proposes to use copolymers obtained by solution polymerization of vinyl esters, while JP-A-59-202463 proposes to use copolymers obtained by solution polymerization of ethylenic unsaturated methacrylates having reactive groups such as phthalimido.

Although the timing layers disclosed in these patents make it possible to compensate the temperature in the neutralization reaction of developing solutions, the range of the temperature thus compensated is very narrow, compared with the temperature range employed in the instant photography in practice, in each case and thus only unsatisfactory images can be obtained thereby.

In addition, the above-mentioned timing layers frequently suffer from a problem that, when stored under high humidity at high temperature, the neutralization timing period is prolonged due to the poor storage stability with time and thus the maximum and minimum densities are elevated. This problem relates closely to the Tg of the polymer material employed in the timing layer. Namely, a higher Tg brings about the more serious problem.

Such a timing layer is frequently located next to the layer wherein an alkali processing composition is developed. However, it is often observed that the timing layer adheres to the opposite layer, between which the development layer is sandwiched, before the development of the processing composition and thus the processing composition cannot be uniformly developed, i.e., an adhesion trouble. This trouble also relates closely to the Tg of the polymer material employed in the timing layer. In this case, the problem is that a lower Tg would cause the trouble more often.

Accordingly, a Tg of the polymer affects to the storage stability with time and to the adhesion trouble oppositely each other, which makes it very difficult to regulate the Tg of a single polymer so as to satisfy both of these requirements.

SUMMARY OF THE INVENTION

An object of the present invention is to provide photographic elements which have good processing temperature properties, excellent storage stability with time and excellent adhesion resistance of sheets between which an alkali processing composition development layer is inserted.

Other objects and effects of the present invention will become apparent from the following description.

The above described objects of the present invention have been achieved by providing:

(1) a photographic element which comprises at least one temporary barrier layer formed by applying an organic solvent solution containing at least two kinds of copolymers, wherein each of said at least two kinds of copolymers comprises, as its constituents, at least one monomer selected from group A, at least one monomer selected from group B, and at least one monomer selected from group C:

group A: mono(meth)acrylates of polyhydric alcohols;

group B: ethylenic unsaturated monomers having a carboxyl group; and group C: ethylenic unsaturated monomers which are other than those of groups A and B, and which are copolymerizable with the monomers of groups A and B;

(2) the photographic element according to the above (1), wherein said at least two kinds of copolymers include:

at least one copolymer having a glass transition temperature (Tg) of from not lower than 65° C. to not higher than 150° C.; and at least one copolymer having a Tg of from not lower than 0 to lower than 65;

(3) the photographic element according to the above (1), wherein said at least two kinds of copolymers are mixed at a mixing ratio that gives a Tg of the mixture of from 40° C. to 75° C.; and (4) a diffusion transfer photographic element, which comprises at least one temporary barrier layer as claimed in the above (1).

DETAILED DESCRIPTTON OF THE INVENTION

The monomers of group A are used in order to improve the alkali-permeability, water-permeability and capability of temperature-compensating. It can be considered that hydroxyl groups remaining in the side chains of acrylates or methacrylates participate in the development of the above-mentioned functions. Regarding the capability of temperature-compensating, in particular, it is estimated that the intermolecular actions of hydroxyl groups with each other or those between hydroxyl groups and the carboxyl groups contained in the side chains of the monomers of group B affect largely.

The monomers of group B are used mainly to impart the alkali-permeability and water-permeability.

The monomers of group C are selected in order to control the characteristics (solubility, hydrophobic or hydrophilic nature, ionic nature, etc.) of the copolymers. As described above, it is particularly meaningful in the present invention to control the Tg so as to improve the storage stability with time and the adhesion resistance of the layers between which alkali-processing composition layer(s) are inserted. Therefore, the monomers of group C are selected mainly to achieve this object.

The monomers of group A are specifically exemplified as follows, though the present invention is not limited thereto: 2-hydroxyethyl acrylate, 3-hydroxypropyl acrylate, 2-hydroxypropyl acrylate, 4-hydroxybutyl acrylate, 5-hydroxypentyl acrylate, 2,2-dimethyl-3-hydroxypropyl acrylate, diethylene glycol monoacrylate, trimethylolpropane monoacrylate, pentaerythritol monoacrylate, 2-hydroxyethyl methacrylate, 3-hydroxypropyl methacrylate, 2-hydroxypropyl methacrylate, 4-hydroxybutyl methacrylate, 5-hydroxypentyl methacrylate, 2,2-dimethyl-3-hydroxypropyl methacrylate, diethylene glycol monomethacrylate, trimethylolpropane monomethacrylate and pentaerythritol monomethacrylate. One of these monomers may be used singly. Alternatively, use can be made of two or more thereof in combination.

The monomers of group B are specifically exemplified as follows, though the present invention is not limited thereto: acrylic acid, methacrylic acid, itaconic acid, maleic acid, maleic anhydride, vinylbenzoic acid, and

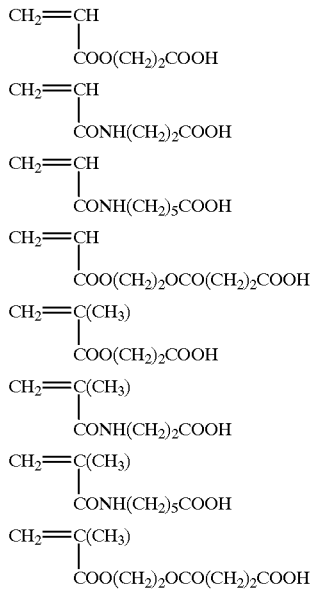

One of these monomers may be used singly. Alternatively, use can be made of two or more thereof in combination.

The monomers of group C are specifically exemplified as follows, though the present invention is not limited thereto: ethylene, propylene, 1-butene, isobutene, styrene, chloromethylstyrene, hydroxymethylstyrene, α-methylstyrene, vinyltoluene, 4-vinylpyridine, 2-vinylpyridine, N-vinylacetamide, N-vinylpyrrolidone, 1-vinyl-2-methylimidazole, ethylenic unsaturated esters of aliphatic acids (vinyl acetate, allyl acetate, etc.), ethylenic unsaturated monocarboxylates or dicarboxylates (methyl acrylate, ethyl acrylate, n-propyl acrylate, isopropyl acrylate, n-butyl acrylate, t-butyl acrylate, n-hexyl acrylate, 2-ethylhexyl acrylate, cyclohexyl acrylate, benzyl acrylate, chloroethyl acrylate, methoxyethyl acrylate, N,N-diethylaminoethyl acrylate, methyl methacrylate, ethyl methacrylate, n-propyl methacrylate, isopropyl methacrylate, n-butyl methacrylate, t-butyl methacrylate, n-hexyl methacrylate, 2-ethylhexyl methacrylate, cyclohexyl methacrylate, benzyl methacrylate, chloroethyl methacrylate, methoxyethyl methacrylate, N,N-diethylaminoethyl methacrylate, dimethyl itaconate, monobenzyl maleate, etc.) and ethylenic unsaturated monocarboxamides or dicarboxamides [acrylamide, N,N-dimethylacrylamide, N-methylolacrylamide, N-(N,N-dimethylaminopropyl)acrylamide, acryloylmorpholine, methacrylamide, N,N-dimethylmethacrylamide, N-methylolmethacrylamide, N-(N,N-dimethylaminopropyl) methacrylamide, methacryloylmorpholine, etc.). To obtain crosslinked polymers, it is also possible to use therefor monomers carrying two or more ethylenic unsaturated groups such as divinylbenzene, methylenebisacrylamide, ethylene glycol diacrylate, trimethylene glycol diacrylate, neopentyl glycol diacrylate, methylenebismethacrylamide, ethylene glycol dimethacrylate, trimethylene glycol dimethacrylate and neopentyl glycol dimethacrylate. One of these monomers may be used singly. Alternatively, use can be made of two or more thereof in combination.

By taking the hydrophilic nature, hydrophobic nature, polymerization reactivity, the film-forming properties of the polymer materials obtained therefrom, etc. into consideration, among these monomers, 2-hydroxyethylacrylate and 2-hydroxyethylmethacrylate are preferred as the monomer of group A, acrylic acid and methacrylic acid are preferred as the monomer of group B, and acrylates, methacrylates and styrenes are preferred as the monomer of group C.

The content of the monomer of group A preferably ranges from 1 to 50% by mol, still preferably from 10 to 40% by mol. The content of the monomer of group B preferably ranges from 1 to 40% by mol, still preferably from 1 to 20% by mol. The content of the monomer of group C preferably ranges from 1 to 90% by mol, still preferably from 50 to 80% by mol. The content of each monomer in appropriately selected depending on the desired properties.

The present invention aims at simultaneously achieving two inconsistent objects, namely, excellent storage stability with time, which requires a high Tg (i.e., higher than about 65° C.) of a polymer material, and good adhesion resistance of sheets, which requires a low Tg (i.e., lower than about 65° C.) thereof. These two requirements cannot be satisfied at the same time by using a single polymer material. It is, therefore, essentially required to use a mixture of two or more polymer materials, as described in the present invention. It is particularly preferred to use a mixture of a polymer having a high Tg of at least 65° C. to achieve excellent storage stability with time and another polymer having a low Tg of less than 65° C. to achieve good adhesion resistance. Although the polymer having a high Tg may be an arbitrary one so long as it has Tg of 65° C. or above, it is preferable to use one having a Tg of from 65° C. to 150° C., still preferably from 65° C. to 100° C., from the viewpoints of handling characteristics, physical properties at film formation, etc. Similarly, the polymer having a low Tg may be an arbitrary one so long as it has Tg less than 65° C. However, it is preferable to use one having a Tg of from 0° C. to less than 65° C., still preferably from 20° C. to less than 65° C., from the viewpoints of handling characteristics, film-forming properties, etc.

When two or more polymers being less compatible with each other are used as a mixture thereof, it is feared that the stability of the coating solution is lowered and the transparency of the coating film is deteriorated. In the present invention, good compatibility over a broad range (monomer type, mixing ratio, etc.) has been successfully achieved by essentially copolymerizing monomer(s) of group A and those of group B in the polymers to be mixed.

The mixing ratio of the polymers may vary within the range of 1:99 to 99:1 (by weight), so long as the solutions are highly compatible with each other without showing any phase separation. However, it is preferable that the mixing is carried out at such a ratio as allowing the exhibition of the characteristics of each polymer (i.e., 10:90 to 90:10, by weight). It is furthermore preferable that the Tg of the resultant polymer mixture falls within the range of from 40° C. to 75° C. so that both of a high storage stability with time and a good adhesion resistance can be achieved.

The polymers for use in the present invention are those having a weight-average molecular weight of from 3,000 to 1,000,000, preferably from 5,000 to 500,000 and still preferably from 10,000 to 300,000.

Typical useful examples of the copolymers having a glass transition temperature (Tg) of from not lower than 65° C. to not higher than 150° C. (hereinafter referred to "copolymers of group I") and of the copolymers having a Tg of from not lower than 0° C. to lower than 65° C. (hereinafter referred to "copolymers of group III") are enumerated below, but the present invention is not limited thereto. The ratios described in the parentheses are molar percentage.

| Copolymers of group I: | |
|---|---|
| I-1 | 2-hydroxyethyl methacrylate/acrylic acid/methyl methacrylate copolymer (20/10/70), m.w.: 25,000 |
| I-2 | 2-hydroxyethyl methacrylate/acrylic acid/ethyl methacrylate copolymer (30/5/65), m.w.: 25,000 |
| I-3 | 2-hydroxyethyl methacrylate/acrylic acid/ethyl methacrylate copolymer (20/10/70), m.w.: 25,000 |
| I-4 | 2-hydroxyethyl methacrylate/acrylic acid/ethyl methacrylate copolymer (10/15/75), m.w.: 25,000 |
| I-5 | 2-hydroxyethyl methacrylate/acrylic acid/ethyl methacrylate copolymer (1/20/79), m.w.: 25,000 |
| I-6 | 2-hydroxyethyl methacrylate/acrylic acid/propyl methacrylate copolymer (20/10/70), m.w.: 30,000 |
| I-7 | 2-hydroxyethyl methacrylate/acrylic acid/isopropyl methacrylate copolymer (20/10/70), m.w.: 30,000 |
| I-8 | 2-hydroxyethyl methacrylate/acrylic acid/t-butyl methacrylate copolymer (20/10/70), m.w.: 30,000 |
| I-9 | 2-hydroxyethyl methacrylate/acrylic acid/cyclohexyl methacrylate copolymer (20/10/70), m.w.: 40,000 |
| I-10 | 2-hydroxyethyl methacrylate/acrylic acid/benzyl methacrylate copolymer (20/10/70), m.w.: 35,000 |
| I-11 | 2-hydroxyethyl methacrylate/acrylic acid/methyl methacrylate/styrene copolymer (20/10/60/10), m.w.: 35,000 |
| I-12 | 2-hydroxyethyl methacrylate/acrylic acid/methyl methacrylate/styrene copolymer (20/10/50/20), m.w.: 35,000 |
| I-13 | 2-hydroxyethyl methacrylate/methacrylic acid/methyl methacrylate copolymer (20/10/70), m.w.: 25,000 |
| I-14 | 2-hydroxyethyl methacrylate/methacrylic acid/ethyl methacrylate copolymer (30/5/65), m.w.: 25,000 |
| I-15 | 2-hydroxyethyl methacrylate/methacrylic acid/ethyl methacrylate copolymer (20/10/70), m.w.: 25,000 |
| I-16 | 2-hydroxyethyl methacrylate/methacrylic acid/propyl methacrylate copolymer (20/10/70), m.w.: 30,000 |
| I-17 | 2-hydroxyethyl methacrylate/methacrylic acid/t-butyl methacrylate copolymer (20/10/70), m.w.: 45,000 |
| I-18 | 2-hydroxyethyl methacrylate/methacrylic acid/cyclohexyl methacrylate copolymer (20/10/70), m.w.: 55,000 |
| I-19 | 2-hydroxyethyl methacrylate/methacrylic acid/t-butyl acrylate copolymer (20/10/70), m.w.: 40,000 |
| I-20 | 2-hydroxyethyl methacrylate/methacrylic acid/methyl methacrylate/styrene copolymer (20/10/60/10), m.w.: 40,000 |
| I-21 | 2-hydroxyethyl acrylate/acrylic acid/methyl methacrylate copolymer (20/10/70), m.w.: 20,000 |
| I-22 | 2-hydroxyethyl acrylate/acrylic acid/t-butyl methacrylate copolymer (20/10/70), m.w.: 25,000 |
| I-23 | 2-hydroxyethyl acrylate/acrylic acid/cyclohexyl methacrylate copolymer (20/10/70), m.w.: 35,000 |
| I-24 | 2-hydroxyethyl acrylate/acrylic acid/methyl methacrylate/styrene copolymer (20/10/60/10), m.w.: 20,000 |
| I-25 | 2-hydroxyethyl acrylate/methacrylic acid/methyl methacrylate copolymer (20/10/70), m.w.: 20,000 |
| I-26 | 2-hydroxyethyl acrylate/methacrylic acid/t-butyl methacrylate copolymer (20/10/70), m.w.: 30,000 |
| I-27 | 2-hydroxyethyl acrylate/methacrylic acid/cyclohexyl methacrylate copolymer (20/10/70), m.w.: 35,000 |
| I-28 | 2-hydroxyethyl acrylate/methacrylic acid/methyl methacrylate/styrene copolymer (20/10/60/10), m.w.: 25,000 |

| Copolymers of group II (% by mol): | |
|---|---|
| II-1 | 2-hydroxyethyl methacrylate/acrylic acid/n-butyl methacrylate copolymer (30/5/65), m.w.: 25,000 |
| II-2 | 2-hydroxyethyl methacrylate/acrylic acid/n-butyl methacrylate copolymer (20/10/70), m.w.: 25,000 |
| II-3 | 2-hydroxyethyl methacrylate/acrylic acid/n-butyl methacrylate copolymer (10/15/75), m.w.: 25,000 |
| II-4 | 2-hydroxyethyl methacrylate/acrylic acid/n-butyl methacrylate copolymer (1/20/79), m.w.: 25,000 |
| II-5 | 2-hydroxyethyl methacrylate/acrylic acid/2-ethylhexyl methacrylate copolymer (20/10/70), m.w.: 40,000 |
| II-6 | 2-hydroxyethyl methacrylate/acrylic acid/methyl acrylate copolymer (20/10/70), m.w.: 20,000 |

-continued

| Copolymers of group II (% by mol): | |
|---|---|
| II-7 | 2-hydroxyethyl methacrylate/acrylic acid/ethyl acrylate copolymer (20/10/70), m.w.: 20,000 |
| II-8 | 2-hydroxyethyl methacrylate/acrylic acid/propyl acrylate copolymer (20/10/70), m.w.: 25,000 |
| II-9 | 2-hydroxyethyl methacrylate/acrylic acid/n-butyl acrylate copolymer (30/5/65), m.w.: 25,000 |
| II-10 | 2-hydroxyethyl methacrylate/acrylic acid/n-butyl acrylate copolymer (20/10/70), m.w.: 25,000 |
| II-11 | 2-hydroxyethyl methacrylate/acrylic acid/2-ethylhexyl acrylate copolymer (20/10/70), m.w.: 40,000 |
| II-12 | 2-hydroxyethyl methacrylate/acrylic acid/cyclohexyl acrylate copolymer (20/10/70), m.w.: 40,000 |
| II-13 | 2-hydroxyethyl methacrylate/acrylic acid/benzyl acrylate copolymer (20/10/70), m.w.: 40,000 |
| II-14 | 2-hydroxyethyl methacrylate/methacrylic acid/n-butyl methacrylate copolymer (30/5/65), m.w.: 30,000 |
| II-15 | 2-hydroxyethyl methacrylate/methacrylic acid/n-butyl methacrylate copolymer (20/10/70), m.w.: 30,000 |
| II-16 | 2-hydroxyethyl methacrylate/methacrylic acid/n-butyl acrylate copolymer (30/5/65), m.w.: 25,000 |
| II-17 | 2-hydroxyethyl methacrylate/methacrylic acid/n-butyl acrylate copolymer (20/10/70), m.w.: 30,000 |
| II-19 | 2-hydroxyethyl methacrylate/methacrylic acid/cyclohexyl acrylate copolymer (20/10/70), m.w.: 45,000 |
| II-20 | 2-hydroxyethyl methacrylate/methacrylic acid/benzyl acrylate copolymer (20/10/70), m.w.: 45,000 |
| II-21 | 2-hydroxyethyl acrylate/acrylic acid/ethyl methacrylate copolymer (30/5/65), m.w.: 25,000 |
| II-22 | 2-hydroxyethyl acrylate/acrylic acid/propyl methacrylate copolymer (20/10/70), m.w.: 25,000 |
| II-23 | 2-hydroxyethyl acrylate/acrylic acid/n-butyl methacrylate copolymer (30/5/65), m.w.: 25,000 |
| II-24 | 2-hydroxyethyl acrylate/acrylic acid/n-butyl methacrylate copolymer (20/10/70), m.w.: 25,000 |
| II-25 | 2-hydroxyethyl acrylate/acrylic acid/t-butyl acrylate copolymer (20/10/70), m.w.: 25,000 |
| II-26 | 2-hydroxyethyl acrylate/acrylic acid/cyclohexyl acrylate copolymer (20/10/70), m.w.: 40,000 |
| II-27 | 2-hydroxyethyl acrylate/acrylic acid/benzyl acrylate copolymer (20/10/70), m.w.: 45,000 |
| II-28 | 2-hydroxyethyl acrylate/methacrylic acid/propyl methacrylate copolymer (20/10/70), m.w.: 25,000 |
| II-29 | 2-hydroxyethyl acrylate/methacrylic acid/n-butyl methacrylate copolymer (30/5/65), m.w.: 30,000 |
| II-30 | 2-hydroxyethyl acrylate/methacrylic acid/n-butyl methacrylate copolymer (20/10/70), m.w.: 30,000 |
| II-31 | 2-hydroxyethyl acrylate/methacrylic acid/t-butyl acrylate copolymer (20/10/70), m.w.: 25,000 |
| II-32 | 2-hydroxyethyl acrylate/methacrylic acid/cyclohexyl acrylate copolymer (20/10/70), m.w.: 45,000 |
| II-33 | 2-hydroxyethyl acrylate/methacrylic acid/benzyl acrylate copolymer (20/10/70), m.w.: 45,000. |

The polymers of the present invention can be obtained by commonly known polymerization methods. It is preferable to select the solution polymerization method or the suspension polymerization method (see, for example, "Kobunshi Gosei no Jikkenho (Experimental methods for synthesizing polymers)", pages 124–154, Kagaku Dojin, 1972) for producing these polymers.

To effect the solution polymerization which is a particularly preferable method in the present invention, use may be made of solvents in which the above-mentioned monomers of groups A, B and C are soluble, for example, organic solvents such as methanol, ethanol, propanol, ethylene glycol, acetone, methyl ethyl ketone, acetonitrile, dioxane, N,N-dimethylformamide, tetrahydrofuran or ethyl acetate, either alone or as a mixture thereof or a solvent mixture with water.

The solution polymerization as described above is performed by using a commonly employed radical initiator (for example, an azo-type initiator such as 2,2'-azobisisobutyronitrile or a peroxide initiator such as benzoyl peroxide) at a temperature of usually 30° C. to 100° C., preferably 40° C. to 90° C.

An example of the polymerization by the solution polymerization method is described below.

SYNTHESIS EXAMPLE 1

Synthesis of poly(2-hydroxyethyl methacrylate/acrylic acid/ethyl methacrylate) (20/10/70 mol %) (Copolymer I-3 enumerated above)

Into a reactor were introduced 210 ml of methyl ethyl ketone, 6.9 g of 2-hydroxyethyl methacrylate, 1.9 g of acrylic acid and 21.2 g of ethyl methacrylate. After purging the reactor with nitrogen, the mixture was heated to 75° C. Next, a solution of 3.0 g of dimethyl-2,2'-azobisisobutyrate in 20 ml of methyl ethyl ketone was added thereto and the polymerization was initiated. A monomer solution consisting of 62.1 g of 2-hydroxyethyl methacrylate, 17.2 g of acrylic acid and 190.7 g of ethyl methacrylate and an initiator solution of 3.0 g of dimethyl-2,2'-azobisisobutyrate in 50 ml of methyl ethyl ketone were dropped into the container each over 6 hours. After the completion of the addition, 3.0 g of dimethyl-2,2'-azobisisobutyrate dissolved in 20 ml of methyl ethyl ketone was further added and the resultant mixture was heated and stirred for 4 hours to give a colorless, transparent and viscous liquid reaction mixture. The liquid reaction mixture was cooled to room temperature and then 245 ml of methyl ethyl ketone was added thereto to lower the viscosity to give 706 g of a copolymer solution having a solid content of 42.9% (polymer yield: 98.0%).

Other copolymers enumerated above can be obtained by a similar polymerization method.

The copolymers of the present invention can be applied, either in the form of a copolymer solution as obtained by the solution polymerization method or in the form of a mixture with an appropriate solvent compatible therewith, onto the substrate. As the appropriate solvent, use can be made of the above-mentioned organic solvents such as methanol, ethanol, propanol, ethylene glycol, acetone, methyl ethyl ketone, acetonitrile, dioxane, N,N-dimethylformamide, tetrahydrofuran and ethyl acetate, either alone or as a mixture of two or more thereof or a solvent mixture with water. In the case of using a solvent mixture with water, it should be noted that the content of water is regulated so as to prevent the copolymer from becoming insoluble or hardly compatible with other solvents. Alternatively, copolymers obtained by the suspension polymerization method may be dissolved in an appropriate solvent as described above and then applied onto the substrate. Thus, a temporary barrier layer comprising the copolymers can be integrated into the photographic element. This temporary barrier layer may contain components other than the polymers for use in the present invention.

When the copolymers of the present invention are applied in the form of a solution in an organic solvent, the concentration and viscosity of the solution are not particularly limited, so long as the solution may be applied without any trouble and gives a good coated face after drying. It is preferable that its concentration ranges from 1% to 40%, still preferably from 2% to 20%, while its viscosity ranges from 0.1 cps to 1,000 cps, still preferably from 1 to 100 cps.

The photographic elements of the present invention involve photosensitive materials, image receiving materials and cover sheet for the diffusion transfer process. The photosensitive materials may be in the form of diffusion transfer film units comprising a photosensitive element, an image receptor and a processing element. Anyway, such a photosensitive material has, as an essential constituent thereof, at least one silver halide emulsion layer formed on a substrate usually together with an intermediate layer, etc. inserted between them. The polymers of the present invention are contained in layers for forming a temporary barrier against the diffusion (permeation) of a processing composition, for example, a timing layer in a cover sheet, an intermediate layer in a photosensitive material or a neutralization timing layer in a image receiving material (or an image receiving element), preferably in a timing layer in a cover sheet or an appropriate layer (an intermediate layer, etc.) of a photosensitive material. The application amount of these polymers ranges from 0.5 to 10 $g/m^2$ (in the case of a photosensitive material), preferably from 1 to 10 $g/m^2$ and still preferably from 1 to 8 $g/m^2$.

To reproduce natural colors by the subtractive color process, use is made of at least two photosensitive materials comprising a silver halide emulsion having a selective spectral sensitivity within a specific wavelength range and a dye image-forming compound (hereinafter referred to as a "coloring material", or a coloring material containing a group capable of forming such a dye) having a selective spectral sensitivity within this wavelength range.

Particularly useful photosensitive elements involve those comprising a combination of a blue-photosensitive silver halide emulsion with a yellow coloring material, that of a green-photosensitive silver halide emulsion with a magenta coloring material and that of a red-photosensitive emulsion with a cyan coloring material. These emulsion/coloring material combination units may be applied to form laminated layers in a photosensitive material. Alteratively, these combination units may be processed into grains each having both of a coloring material and a silver halide and then blended together followed by application to form a single layer.

Now, the photographic element of the present invention is described below by taking as an example a coloring material releasing a diffusible dye for forming a transfer image.

First, the constituting elements of the present invention is described.

I. Constituents (Layers) Forming Photosensitive Sheet or Image Receiving Sheet

A) Substrate

As the substrate of the photosensitive sheet to be used in the present invention, use is made of smooth and transparent or opaque substrates commonly employed in photographic photosensitive materials.

Examples of the transparent substrates include cellulose acetate, polystyrene, polyethylene terephthalate and polycarbonate which are preferably provided with an undercoating layer. In general, it is preferable that the substrate contain a trace amount of a dye or a pigment such as titanium oxide to prevent light piping.

The thickness of the substrate ranges from 50 to 350 $\mu$m, preferably from 70 to 210 $\mu$m and still preferably from 80 to 150 $\mu$m.

Examples of the opaque substrates include paper coated or laminated with a baryta layer or $\alpha$-olefin polymers (polyethylene, polypropylene, polyester, ethylene/butene copolymer, etc.). Alteratively, use may be made therefor of the above-mentioned transparent films containing white pigments.

If necessary, the substrate may be provided at the back side with a curl-balance layer or an oxygen barrier layer described in JP-A-56-78833.

B) Image Receiving Layer

The dye image receiving-layer to be use din the present invention contains a mordant in a hydrophilic colloid. The image receiving layer may be composed of either a single layer or two or more layers laminated on each other which contain mordants different in mordant power from each other, as described in detail in JP-A-61-252551. Polymer mordants are preferable therefor.

The polymer mordants involve, for example, polymers containing secondary and tertiary amino groups, those having nitrogen-containing heterocycle moieties and those containing quaternary cations and having a molecular weight of from 5,000 to 500,000, particularly preferably from 10,000 to 300,000.

In general, the application amount of such a mordant ranges from 0.5 to 10 $g/m^2$, preferably from 1.0 to 5.0 $g/m^2$ and still preferably from 2 to 4 $g/m^2$.

Examples of the hydrophilic colloid for use in the image receiving layer include gelatin, polyvinyl alcohol, polyacrylamide and polyvinylpyrrolidone. Among all, gelatin is preferred.

The image receiving layer may contain fading inhibitors described in JP-A-62-30620, JP-A-62-30621 and JP-A-62-215272.

C) White Reflective Layer

A white reflective layer forming the white background of color images usually contains white pigments and hydrophilic binders.

Examples of the white pigments in the white reflective layer include barium sulfate, zinc oxide, barium stearate, silver flakes, silicates, alumina, zirconium oxide, zirconium sodium sulfate, kaolin, mica and titanium oxide. Further, non-film-forming polymer grains made of styrene, etc. are also employed therefor. Either one of these pigment may be used. Alternatively, they may be used in the form of a mixture to give the desired reflectance.

Among all, titanium oxide is particularly useful as a white pigment.

Although the whiteness of the white reflective layer varies depending on the type of the pigment, the mixing ratio of the pigment with the binder and the application amount of the pigment, a whiteness capable of giving a reflectance of at least 70% is preferable. Generally, the whiteness is elevated with an increase in the application amount of the pigment. When image-forming dyes are diffused through this layer, however, the pigment interferes the diffusion of the pigments. It is therefore preferable to appropriately control the application amount of the pigment.

More particularly, a preferred white reflective layer is one containing 5 to 40 $g/m^2$, still preferably 10 to 25 $g/m^2$ of titanium oxide and having a reflectance of light at 540 nm of 78 to 85%.

Titanium oxide may be selected from among various marketed products. Among all, it is preferable to use rutile-form titanium oxide.

Many of marketed products have been surface-treated with alumina, silica, zinc oxide, etc. To achieve a high reflectance, it is preferable to use one having a surface-treatment amount of at least 5%. Examples of marketed titanium oxide products include Ti-pure R931 manufactured by Du Pont and those described in Research Disclosure, No. 15162.

Examples of the binder of the white reflective layer include alkali-permeable polymer matrixes such as gelatin and polyvinyl alcohol and cellulose derivatives such as hydroxyethyl cellulose and carboxymethyl cellulose.

As the binder of the white reflective layer, it is particularly preferable to use gelatin. The white pigment and gelatin are employed at a weight ratio of from 1/1 to 20/1, preferably from 5/1 to 10/1.

It is preferable that the white reflective layer contain a fading inhibitor, for example, those disclosed in JP-B-62-30620 and JP-B-62-30621 (the term "JP-B" as used herein means an "examined Japanese patent publication").

D) Light Screening Layer

A light screening layer-containing a light screening agent and a hydrophilic binder is provided between the white reflective layer and the photosensitive layer.

Although any light screening agent is usable so long as it is capable of screening light, carbon black is preferable therefor. Also, use may be made of degradable dyes described in U.S. Pat. No. 4,615,966, etc.

As the binder on which the light screening agent is to be applied may be an arbitrary one, so long as carbon black is dispersible therein. It is preferable to use gelatin therefor.

The carbon black for use in the present invention may be obtained by an arbitrary method, for example, the channel method, the thermal method or the furnace method described in Donnel Voet "Carbon Black" Marcel Dekker, INc. (1976). The grain size of the carbon black preferably ranges from 90 to 1800 Å, though the present invention is not limited thereto. The content of a black pigment employed as the light screening agent may be controlled depending on the sensitivity of the photosensitive sheet to be screened, preferably such a level as to give an optical density of 5 to 10.

E) Photosensitive Layer

In the present invention, a photosensitive layer comprising a silver halide emulsion layer combined with dye image-forming substances is provided on the above-mentioned light screening layer. Now, each constituent thereof is described below.

(1) Dye Image-forming Substance

The dye image-forming substances to be used in the present invention are non-diffusible compounds capable of releasing diffusible dyes (or dye precursors) in association with silver-development or those having variable diffusibility per se which are described in "The Theory of the Photographic Process" 4th ed. Each of these compounds can be represented by the following general formula (1):

$$(DYE-Y)_n-Z \quad (1)$$

wherein DYE represents a dye group, a temporary short-wave dye group or a dye precursor group; Y represents a bond or a linking group; Z represents a group capable of causing a difference in the diffusibility of compounds represented by the formula $(DYE-Y)_n-Z$ corresponding, either directly or reversely, to the photosensitive silver salt having a latent image, or releasing the DYE so that cause a difference in the diffusibility between the released DYE and $(DYE-Y)_n-Z$; and n is 1 or 2, provided that two DYEs may be the same or different when n is 2.

Depending on the function of Z, these compounds are roughly classified into negative compounds being diffusible in the silver-developed areas and positive ones being diffusible in the undeveloped areas.

Examples of Z of the negative type include those which are oxidized and cleaved to thereby release diffusible dyes after oxidation.

Particular examples of Z are described in U.S. Pat. No. 3,928,312, U.S. Pat. No. 3,993,638, U.S. Pat. No. 4,076,529, U.S. Pat. No. 4,152,153, U.S. Pat. No. 4,055,428, U.S. Pat. No. 4,053,312, U.S. Pat. No. 4,198,235, U.S. Pat. No. 4,179,291, U.S. Pat. No. 4,149,892, U.S. Pat. No. 3,844,785, U.S. Pat. No. 3,443,943, U.S. Pat. No. 3,751,406, U.S. Pat. No. 3,443,939, U.S. Pat. No. 3,443,940, U.S. Pat. No. 3,628,952, U.S. Pat. No. 3,980,479, U.S. Pat. No. 4,183,753, U.S. Pat. No. 4,142,891, U.S. Pat. No. 4,278,750, U.S. Pat. No. 4,139,379, U.S. Pat. No. 4,218,368, U.S. Pat. No. 3,421,964, U.S. Pat. No. 4,199,355, U.S. Pat. No. 4,199,354, U.S. Pat. No. 4,135,929, U.S. Pat. No. 4,336,322, U.S. Pat. No. 4,139,389, JP-A-53-50736, JP-A-51-104343, JP-A-54-130122, JP-A-53-110827, JP-A-56-12642, JP-A-16131, JP-A-57-4043, JP-A-57-650, JP-A-57-20735, JP-A-53-69033, JP-A-54-130927, JP-A-56-164342, JP-A-57-119345, etc.

Among the Z groups in these negative redox compounds releasing dyes, particularly preferable ones are N-substituted sulfamoyl groups wherein the N-substituents means groups derived from aromatic hydrocarbon rings or heterorings. Typical examples thereof are the following ones, though the present invention is not limited thereto.

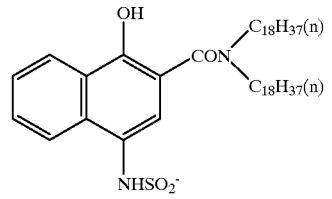

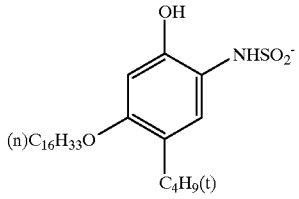

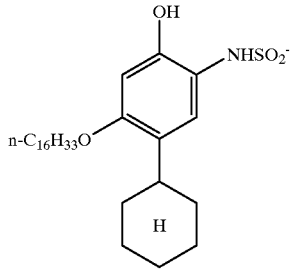

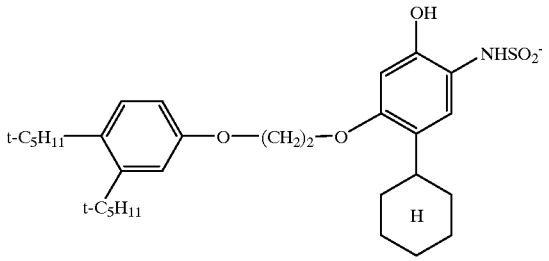

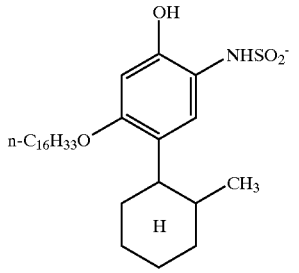

The positive compounds are described in Angev. Chem. Inst. Ed. Engl., 22, 191 (1982).

Particular examples thereof include compounds (dye developers) which are first diffusible under alkaline conditions but become non-diffusible when oxidized via development. Typical examples of the Z groups effective in these compounds are those described in U.S. Pat. No. 2,983,606.

Examples of another type thereof are compounds which release diffusible dyes via, for example, self-ring closure under alkaline conditions but substantially cease the release of the dyes when oxidized via development. Particular examples of Zs having this function are those described in U.S. Pat. No. 3,980,479, JP-A-53-69033, JP-A-54-130927, U.S. Pat. No. 3,421,964, U.S. Pat. No. 4,199,355, etc.

Moreover, there are positive compounds of another type which release no dye per se but undergo the release of dyes when reduced. Compounds of this type are employed in combination with electron donors. When silver-developed, such a compound reacts with an electron donor remaining after the oxidation in the form of the image and thus releases a diffusible dye in the form of the image. Examples of the atomic groups having this function are described in U.S. Pat. No. 4,183,753, U.S. Pat. No. 4,142,891, U.S. Pat. No. 4,278,750, U.S. Pat. No. 4,139,379, U.S. Pat. No. 4,218,368, JP-A-53-110827, U.S. Pat. No. 4,278,750, U.S. Pat. No. 4,356,249, U.S. Pat. No. 4,358,525, JP-A-53-110827, JP-A-54-130927, JP-A-56-164342, Published Technical Report No. 87-6199, EP No. 220,746A2, etc.

Specific examples thereof are shown below, though the present invention is not limited thereto.

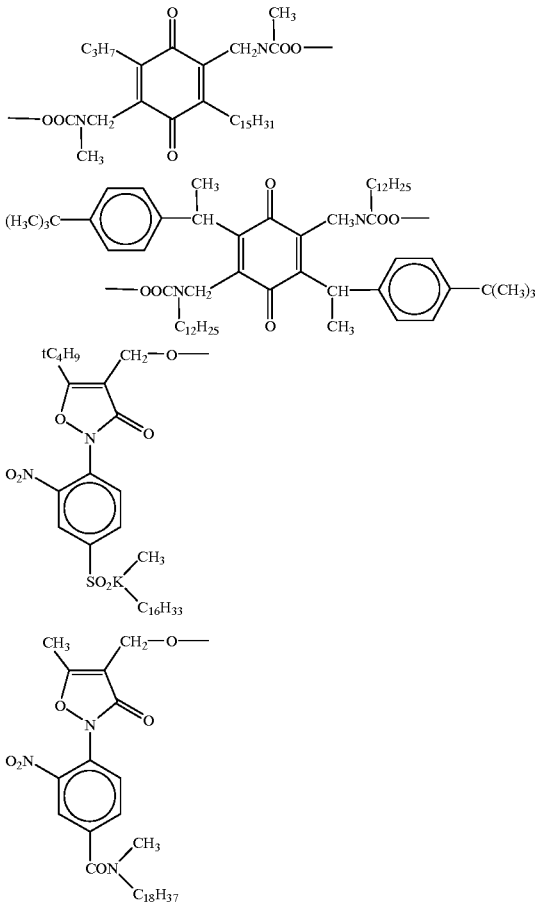

It is preferable that compounds of this type is employed together with diffusion-resistant electron donor compounds (widely known as ED compounds) or precursors thereof. Examples of the ED compounds are described in U.S. Pat. No. 4,263,393, U.S. Pat. No. 4,278,750, JP-A-56-138736, etc.

Furthermore, the following ones are usable as color dye-forming substances of another type.

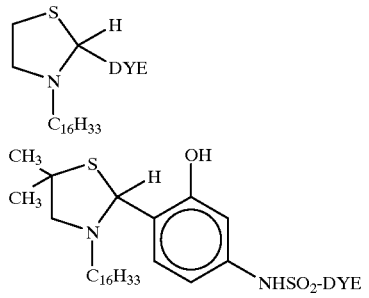

wherein DYE represents the same dye as defined in the above formula (1) or its percussor.

These compounds are described in detail in U.S. Pat. No. 3,719,489 and U.S. Pat. No. 4,098,783.

On the other hand, particular examples of the dye represented by DYE in the above general formula are as follows.

EXAMPLES OF YELLOW DYES

Those described in U.S. Pat. No. 3,597,200, U.S. Pat. No. 3,309,199, U.S. Pat. No. 4,013,633, U.S. Pat. No. 4,245,028, U.S. Pat. No. 4,156,609, U.S. Pat. No. 4,139,383, U.S. Pat. No. 4,195,992, U.S. Pat. No. 4,148,641, U.S. Pat. No. 4,148,643, U.S. Pat. No. 4,336,322, JP-A-51-114930, JP-A-56-71072, Research Disclosure 17630 (1978) and Research Disclosure 16475 (1977).

EXAMPLES OF MAGENTA DYES

Those described in U.S. Pat. No. 3,453,107, U.S. Pat. No. 3,544,545, U.S. Pat. No. 3,932,380, U.S. Pat. No. 3,931,144, U.S. Pat. No. 3,932,308, U.S. Pat. No. 3,954,476, U.S. Pat. No. 4,233,237, U.S. Pat. No. 4,255,509, U.S. Pat. No. 4,250,246, U.S. Pat. No. 4,142,891, U.S. Pat. No. 4,207,104, U.S. Pat. No. 4,287,292, JP-A-52-106727, JP-A-53-23628, JP-A-55-36804, JP-A-56-73057, JP-A-56-71060 and JP-A-55-134.

EXAMPLES OF CYAN DYES

Those described in U.S. Pat. No. 3,482,972, U.S. Pat. No. 3,929,760, U.S. Pat. No. 4,013,635, U.S. Pat. No. 4,268,625, U.S. Pat. No. 4,171,220, U.S. Pat. No. 4,242,435, U.S. Pat. No. 4,142,891, U.S. Pat. No. 4,195,994, U.S. Pat. No. 4,147,544, U.S. Pat. No. 4,148,642, B.P. No. 1,551,138, JP-A-54-99431, JP-A-52-8827, JP-A-53-47823, JP-A-53-143323, JP-A-54-99431, JP-A-56-71061, EP No. 53,037, EP No. 53,040, Research Disclosure 17,630 (1978) and Research Disclosure 16,475 (1977).

These compounds can be all dispersed by the methods described in JP-A-62-215272 (pages 144–146). The resultant dispersions may contain the compounds described in JP-A-62-215272 (pages 137–144).

(2) Silver Halide Emulsion

The silver halide emulsion for use in the present invention may be a negative type emulsion which forms a latent image mainly on the surface of silver halide grains. Alternatively, a directly positive emulsion of the internal latent image type which forms a latent image inside silver halide grains may be used.

Positive emulsions of the internal latent image type include so-called "conversion type" emulsions with the use of difference in solubility of silver halides, the "core-shell type" emulsions in which at least the photosensitive site of the inner core grains of silver halide having been doped with metal ions, chemically sensitized or subjected to both of these treatments are coated with the outer shell of silver halide, etc. as described in U.S. Pat. No. 2,592,259, U.S. Pat. No. 3,206,313, British Patent No. 1,027,146, U.S. Pat. No. 3,761,276, U.S. Pat. No. 3,935,014, U.S. Pat. No. 3,447,927, U.S. Pat. No. 2,297,875, U.S. Pat. No. 2,563,785, U.S. Pat. No. 3,551,662, U.S. Pat. No. 4,395,478, West Germany Patent No. 2,728,108, U.S. Pat. No. 4,431,730, etc.

When such a direct positive emulsion of the internal latent image type is employed, it is needed to form the surface fogging core by using light or a nucleating agent after the exposure of the image.

As the nucleating agent, use may be made of hydrazines described in U.S. Pat. No. 2,563,785 and U.S. Pat. No. 2,588,922, hydrazines and hydrazones described in U.S. Pat. No. 3,227,552, heterocyclic quaternary salt compounds described in British Patent No. 1,283,835, JP-A-52-69613, U.S. Pat. No. 3,615,615, U.S. Pat. No. 3,719,494, U.S. Pat. No. 3,734,738, U.S. Pat. No. 4,094,683, U.S. Pat. No. 4,115,122, etc., sensitizing dyes having nucleating substituents in dye molecules as described in U.S. Pat. No. 3,718,470, thiourea-bonded acylhydrazine compounds described in U.S. Pat. No. 4,030,925, U.S. Pat. No. 4,031,127, U.S. Pat. No. 4,245,037, U.S. Pat. No. 4,255,511, U.S. Pat. No. 4,266,013, U.S. Pat. No. 4,276,364, British Patent No. 2,012,443, etc. and acylhydrazine compounds carrying thioamide rings or heterocyclic groups (triazole, tetrazole, etc.) as adsorption groups.

In the present invention, a color sensitizing dye is used in combination with the above-mentioned negative type emulsion or direct positive emulsion of the internal latent image type. Examples of the color sensitizing dye are those described in JP-A-59-180550, JP-A-60-140335, Research Disclosure (RD) 17029, U.S. Pat. No. 1,846,300, U.S. Pat. No. 2,078,233, U.S. Pat. No. 2,089,129, U.S. Pat. No. 2,165,338, U.S. Pat. No. 2,231,658, U.S. Pat. No. 2,917,516, U.S. Pat. No. 3,352,857, U.S. Pat. No. 3,411,916, U.S. Pat. No. 2,295,276, U.S. Pat. No. 2,481,698, U.S. Pat. No. 2,688,545, U.S. Pat. No. 2,912,067, U.S. Pat. No. 3,282,933, U.S. Pat. No. 3,397,060, U.S. Pat. No. 3,660,103, U.S. Pat. No. 3,335,010, U.S. Pat. No. 3,352,680, U.S. Pat. No. 3,384,486, U.S. Pat. No. 3,628,881, U.S. Pat. No. 3,718,470, U.S. Pat. No. 4,025,349, etc.

(3) Structure of Photosensitive Layer

To reproduce natural colors by the subtractive color process, photosensitive layer(s) is used which comprises at least two materials, i.e., a color sensitized emulsion having been sensitized with the above-mentioned color sensitizing dye combined with the above-mentioned dye image-forming substance capable of providing a dye having a selective sensitivity within the same wavelength range as that of the emulsion. The dye image-forming material may be applied to form a layer on the layer of the emulsion having been applied separately. Alternatively, these materials may be mixed together and then applied to form a single layer. When the dye image-forming material in the applied state has an absorption within the spectral sensitivity range of the emulsion combined therewith, it is preferable to form the layers of these materials separately. The emulsion layer may be composed of two or more emulsion layers different in sensitivity from each other. For example, it is possible to form a layer containing a nucleating development accelerator as described in JP-A-60-173541, a barrier layer described in JP-B-60-15267 to elevate the color image density or a reflective layer to enhance the sensitivity of the photosensitive sheet.

The reflective layer is one containing a white pigment and a hydrophilic binder. It is preferable to use titanium oxide and gelatin respectively as the white pigment and the hydrophilic binder. The application amount of titanium oxide ranges from 0.1 to 8 g/m$^2$, preferably from 0.2 to 4 g/m$^2$. Examples of the reflective layer are given in JP-A-60-91354.

A preferable multilayer structure is composed of, successively from the exposure side, a combination unit of blue-photosensitive emulsions, that of green-photosensitive emulsions and that of red-photosensitive emulsions.

If necessary, arbitrary layers may be put between these emulsion units. It is particularly preferable to provide intermediate layers so as to prevent undesirable effects of the development of an emulsion layer on other emulsion layer units.

When a developing agent is used in combination with a non-diffusible dye image-forming substance, it is preferable that the intermediate layer contains a non-diffusible reducing agent to thereby prevent the diffusion of the oxidized developing agent. More particularly speaking, use may be made therefor of non-diffusible hyroquinone, sulfonamidophenol, sulfonamidonaphthol, etc. Particular examples thereof are described in JP-A-50-21249, JP-A-50-23813, JP-A-49-106329, JP-A-49-129535, U.S. Pat. No. 2,336,327, U.S. Pat. No. 2,360,290, U.S. Pat. No. 2,403,721, U.S. Pat. No. 2,544,640, U.S. Pat. No. 2,732,300, U.S. Pat. No. 2,782,659, U.S. Pat. No. 2,937,086, U.S. Pat. No. 3,637,393, U.S. Pat. No. 3,700,453, British Patent No. 557,750, JP-A-57-24941, JP-A-58-21249, etc. Moreover, JP-A-60-238831 and JP-B-60-18978 discloses methods for dispersing these reducing agents.

When a compound which releases a diffusible dye owing to silver ion as those described in JP-55-7576 is employed, it is preferable that the intermediate layer contains a compound capable of capturing silver ion.

If necessary, the photographic element of the present invention may further have an anti-irradiation layer, an UV-absorption layer, a protective layer, etc.

F) Peeling Layer

If necessary, the photographic element of the present invention may further have a peeling layer so that it can be peeled off at an arbitrary part of the photosensitive sheet in the unit after the completion of the processing. Therefor, this peeling layer should be easily peeled off after the processing. Examples of the materials therefor are described in JP-A-47-8237, JP-A-59-220727, JP-A-59-229555, JP-A-49-4653, U.S. Pat. No. 3,220,835, U.S. Pat. No. 4,359,518, JP-A-49-4334, JP-A-56-65133, JP-A-45-24075, U.S. Pat. No. 3,227,550, U.S. Pat. No. 2,759,825, U.S. Pat. No. 4,401,746, U.S. Pat. No. 4,366,227, etc. For example, use may be made of water soluble (or alkali soluble) cellulose derivatives such as hydroxyethyl cellulose, cellulose acetate phthalate, plasticized methyl cellulose, ethyl cellulose, cellulose nitrate and carboxymethyl cellulose. Alternatively, use may be made therefor of various natural polymers such as alginic acid, pectin and acacia. Moreover, use may be made therefor of various gelatin modifications such as acetylated gelatin and phthalated gelatin. Furthermore, use may be made therefor of water soluble synthetic polymers such as polyvinyl alcohol, polyacrylates, polymethacryaltes, polybutyl methacrylates and copolymers thereof.

The peeling layer may be composed of either a single layer or two or more layers as described in, for example, JP-A-59-220727 and JP-A-60-60642.

II. Neutralization Timing Layer

G) Layer Having Neutralization Function

A layer having neutralization function is generally composed of a neutralization layer and a timing layer containing the polymers of the present invention. This timing layer is located directly or indirectly above or below the neutralization layer so that the alkali processing composition can get to the neutralization layer therethrough. The layer with neutralization function may be involved in the photosensitive sheet, the image receiving sheet or the cover sheet. Also, two or more layers with neutralization function may be employed.

The neutralization layer for use in the present invention is one containing an acidic substance in an amount sufficient for neutralizing the alkali originating in the processing composition. Preferable examples of the acidic substance are those having acidic groups with pKa of 9 or below or precursor groups capable of giving such acidic groups when hydrolyzed. It is still preferable to use therefor higher fatty acids such as oleic acid described in U.S. Pat. No. 2,983,606; polymers of acrylic acid, methacrylic acid or maleic acid, partially esterified products thereof or acid anhydrides disclosed in U.S. Pat. No. 3,362,819; acrylic acid/acrylate copolymers disclosed in French Patent No. 2,290,699; and latex type polymers disclosed in U.S. Pat. No. 4,139,383 and Research Disclosure No. 16102 (1977).

In addition, use may be made therefor of acidic substances disclosed in U.S. Pat. No. 4,088,493, JP-A-52-153739, JP-A-53-1023, JP-A-53-4540, JP-A-53-4541, JP-A-53-4542, etc.

Particular examples of the acidic polymers include copolymers of ethylene, vinyl monomers (vinyl acetate, vinyl methyl ether, etc.) with maleic anhydride, n-butyl ester thereof, butyl acrylate/acrylic acid copolymers, cellulose, acetate hydrogenphthalate, etc.

These polymeric acids may be used as a mixture with hydrophilic polymers. Examples of these polymers include polyacrylamide, polymethylpyrrolidone, polyvinyl alcohol, carboxymethyl cellulose which may be partially saponified, hydroxymethyl cellulose, hydroxyethyl cellulose and polymethyl vinyl ether. Among all, polyvinyl alcohol is preferable therefor.

The above-mentioned polymeric acids may be mixed with polymers other than the hydrophilic polymers, for example, cellulose acetate.

The application amount of the polymeric acid may be controlled depending on the amount of the alkali to be developed on the film unit. It is preferable that the equivalent ratio of the polymeric acid to the alkali per unit area ranges from 0.9 to 2.0. When the amount of the polymeric acid is too small, the color hues of transfer dyes are changed or the white part are stained. When the polymeric acid is used in an excessively large amount, on the other hand, there arise some problem such as changes in the color hues or a decrease in light resistance. The equivalent ratio still preferably ranges from 1.0 to 1.3. Similarly, an excessively small or large amount of the hydrophilic polymer to be mixed with the polymeric acid would cause deterioration in the photographic qualities. The weight ratio of the hydrophilic polymer to the polymeric acid ranges from 0.1 to 10, preferably from 0.3 to 3.0.

In the present invention, the layer with neutralization function may contain additives for various purposes. For example, it may contain hardening agents commonly known in the art for hardening this layer; polyhydric compounds (polyethylene glycol, polypropylene glycol, glycerol, etc.) for improving the brittleness of the film; or surfactants commonly known in the art for improving the coated face. If needed, the layer with neutralization function may further contain antioxidants, fluorescent brighteners, development inhibitors and precursors thereof, etc.

It is preferable in the present invention that the timing layer is put between the layer with neutralization function, if involved in the photosensitive sheet, and the dye donor compound layer; between the layer with neutralization function, if involved in the image receiving sheet, and the image receiv ing layer; or the layer with neutralization function, if involved in the cover sheet, and the layer being in contact with the alkali processing composition.

When the polymer-containing layer for use in the present invention is employed as the timing layer, addition can be made, either to the same timing layer or other timing layer(s), of polymers lowering the alkali-permeability (gelatin, polyvinyl alcohol which may be partially acetalated, cellulose acetate, partially hydrolyzed polyvinyl acetate, etc.); latex polymers prepared by copolymerizing small amount of hydrophilic comonomers (acrylic acid monomer, etc.) and elevating the activation energy of alkali-permeation; polymers having lactone ring, etc.

Among all, particularly useful ones are as follows: timing layers with the use of cellulose acetate as disclosed in U.S. Pat. No. 4,267,262, U.S. Pat. No. 4,009,030, U.S. Pat. No. 4,029,849, etc.; latex polymers prepared by copolymerizing small amount of hydrophilic comonomers such as acrylic acid as disclosed in JP-A-54-128335, JP-A-56-69629, JP-A-57-6843, U.S. Pat. No. 4,056,394, U.S. Pat. No. 4,061,496, U.S. Pat. No. 4,199,362, U.S. Pat. No. 4,250,243, U.S. Pat. No. 4,256,827, U.S. Pat. No. 4,268,604, etc.; polymers having lactone ring as disclosed in U.S. Pat. No. 4,229,516; and polymers disclosed in JP-A-56-25735, JP-A-56-97346, JP-A-57-6842, EP No. 31,957A1, EP No. 37,724A1, EP No. 48,412A1, etc.

In addition, use may be made of those described in the following literatures:

U.S. Pat. No. 3,421,893, U.S. Pat. No. 3,455,686, U.S. Pat. No. 3,575,701, U.S. Pat. No. 3,778,265, U.S. Pat. No. 3,785,815, U.S. Pat. No. 3,847,615, U.S. Pat. No. 4,088,493, U.S. Pat. No. 4,123,275, U.S. Pat. No. 4,148,653, U.S. Pat. No. 4,201,587, U.S. Pat. No. 4,288,523, U.S. Pat. No. 4,297,431, Western Germany Patent Application (OLS) No. 1,622,936, OLS No. 2,162,277 and Research Disclosure 15, 162 No. 151 (1976).

The timing layer made of these materials may be used either in a single layer together with the polymer-containing layer of the present invention or as two or more layers in combination together.

It is possible that the timing layer made of these materials further contains development inhibitors and/or precursors thereof as disclosed in, for example, U.S. Pat. No. 4,009,029, OLS No. 2,913,164, OLS No. 3,014,672, JP-A-54-155837 and JP-A-55-138745; hydroquinone precursors disclosed in U.S. Pat. No. 4,201,578; and other photographically useful additives or precursors thereof.

H) Others

In addition to the layer with neutralization function, use may be made of layers with supplementary functions, for example, a back layer, a protective layer, a filter dye layer, etc.

The back layer is provided in order to regulate curling or impart slipperiness. It may contain filter dyes.

The protective layer is employed mainly to prevent adhesion of the film unit to the back face of the cover sheet or the adhesion of the protective layer of the photosensitive sheet to the cover sheet, if laminated thereon.

It is also possible to add dyes to the cover sheet so as to control the sensitivity of the photosensitive layer. Filter dyes may be added directly to the substrate of the cover sheet or the layer with neutralization function or to the above-mentioned back layer or protective layer. Alternatively, a single layer may be separately formed therefor.

III. Alkali Processing Composition

The processing composition to be used in the present invention is an alkaline solution capable of giving a pH value of from 12 to 14 and containing, for example, alkali metal hydroxides (sodium hydroxide, potassium hydroxide, lithium hydroxide, etc.), alkali metal phosphates (potassium phosphate, etc.), guanidine, or quaternary amine hydroxides (tetramethylammonium hydroxide, etc.). Among all, potassium hydroxide and sodium hydroxide are preferable therefor.

It is necessary to use thickeners to uniformly develop the processing solution or to maintain the adhesion between the photosensitive sheet and the cover sheet or between the photosensitive sheet and the image receiving sheet. Use may be made therefor of alkali metal salts of polyvinyl alcohol, hydroxyethyl cellulose and carboxymethyl cellulose. Preferable examples thereof include hydroxyethyl cellulose and sodium carboxymethyl cellulose.

As the light screening agent, use may be made of either dyes, pigments or a combination thereof, so long as it can be diffused into the dye receiving layer without causing stains. A typical example thereof is carbon black.

The developer may be an arbitrary one, so long as it can cross-oxidize the dye image-forming substance while substantially causing no stain when oxidized. Either a single developer or a mixture of two or more thereof may be used. It is also possible to use developer precursors. These developers may be contained either in an appropriate layer in the photosensitive sheet or in the alkali processing composition. Particular examples thereof include aminophenols and pyrazolidinones. It is particularly preferable to use pyrazolidinones therefor, since they cause lit tl e staining.

Examples thereof include 1-phenyl-3-pyrazolidinone, 1-p-tolyl-4,4-dihydoxymethyl-3-pyrazolidinone, 1-(3'-methyl-phenyl)-4-methyl-4-hydroxymethyl-3-pyrazolidinone, 1-phenyl-4-methyl-4-hydroxymethyl-3-pyrazolidinone and 1-p-tolyl-4-methyl-4-hydroxymethyl-3-pyrazolidinone.

A processing composition to be used in a peel-free type film unit is one which is uniformly developed on the photosensitive sheet after exposure and located on the back face of the substrate or in the opposite side of the processing solution of the photosensitive layer, thus completely protecting the photosensitive layer from the external light together with the light screening layer and, at the same time, developing the photosensitive layer with the use of the components contained therein. Thus, the composition contains an alkali, a thickener, a light screening agent, a developer, a development accelerator or inhibitor for controlling the development, an antioxidant for preventing the deterioration of the developer, etc. The composition also contain a light screening agent as an essential component.

It is furthermore possible that either the photosensitive sheet, the image receiving sheet, the cover sheet or the alkali processing composition contains development accelerators described in pages 72–91 in JP-A-62-215272, hardening agents described in pages 146-155, surfactants described in pages 201–210, fluorine-containing compounds described in pages 210–222, thickeners described in pages 225–227, antistatic agents described in pages 227–230, polymer latexes described in pages 230-239, matrix agents described in page 240, etc.

The present invention will be described in greater detail with reference to the following Examples, but should not be construed as being limited thereto.

EXAMPLE 1

Cover Sheet:

On a polyethylene terephthalte substrate containing a light piping inhibitor and having a gelatin undercoating, the following layers were formed in this order to give a cover sheet 1-1.

(a) A neutralization layer containing 10.4 g/m$^2$ of an acrylic acid/n-butyl acrylate copolymer (80/20 (mol %) and 0.1 g/m$^2$ of 1,4-bis(2,3-epoxypropoxy)butane.

(b) A layer containing 4.3 g/m$^2$ of cellulose acetate with a degree of acetylation of 55% and 0.2 g/m$^2$ of a methyl half ester of methyl vinyl ether/maleic anhydride copolymer (50/50 (mol %)).

(c) A neutralization timing layer containing 1.1 g/m$^2$ of a mixture (1/9 (by weight)) of the above-mentioned copolymers I-3 and II-2.

Moreover, cover sheets 1-2 and 1-3 were prepared by the same method but varying the mixing ratio (by weight) of the copolymers I-3/II-2 to 5/5 and 9/1 respectively.

Further, cover sheets 2-1, 2-2 and 2-3 were prepared by the same method but substituting the copolymers I-3/II-2 employed in the cover sheet 1-1 by the copolymers I-9/II-12 at the mixing ratios (by weight) of 1/9, 5/5 and 9/1 respectively.

Furthermore, cover sheets 3-1, 3-2, 3-3, 3-4, 3-5 and 3-6 were prepared by the same method but substituting the copolymers I-3/II-2 employed in the cover sheet 1-1 by the copolymers I-1/II-6 at the mixing ratios (by weight) of 1/99, 1/9, 3/7, 5/5, 8/2 and 9/1 respectively.

For comparison, cover sheets 4-1, 4-2, 4-3, 4-4 and 4-5 were prepared by the same method but substituting the copolymers I-3/II-2 employed in the cover sheet 1-1 by the copolymer I-3 alone, the copolymer II-2 alone and the following polymers (1), (2) and (3), each employed alone.

(1) 2-Hydroxyethyl methacrylate/acrylic acid/ethyl methacrylate/n-butyl methacrylate copolymer (20/10/8/62 (mol %)).

(2) 2-Hydroxyethyl methacrylate/acrylic acid/ethyl methacrylate/n-butyl methacrylate copolymer (20/10/35/35 (mol %)).

(3) 2-Hydroxyethyl methacrylate/acrylic acid/ethyl methacrylate/n-butyl methacrylate copolymer (20/10/63/7 (mol %)).

For further comparison, cover sheets 5-1, 5-2, 5-3, 5-4 and 5-5 were prepared by the same method but substituting the copolymers I-3/II-2 employed in the cover sheet 1-1 by the copolymer I-1 alone, the copolymer II-6 alone and the following polymers (4), (5) and (6), each employed alone.

(4) 2-Hydroxyethyl methacrylate/acrylic acid/methyl methacrylate/methyl acrylate copolymer (20/10/7/63 (mol %)).

(5) 2-Hydroxyethyl methacrylate/acrylic acid/methyl methacrylate/methyl acrylate copolymer (20/10/35/35 (mol %)).

(6) 2-Hydroxyethyl methacrylate/acrylic acid/methyl methacrylate/methyl acrylate copolymer (20/10/63/7 (mol %)).

For furthermore comparison, cover sheets 6-1, 6-2 and 6-3 were prepared by the same method but substituting the copolymers I-3/II-2 employed in the cover sheet 1-1 by the following polymers (7) and (8), each employed alone, and a mixture of the polymers (7) and (8) (9/1 (by weight)).

(7) Acrylic acid/ethyl methacrylate copolymer (10/90 (mol %)).

(8) Acrylic acid/n-butyl methacrylate copolymer (10/90 (mol %)).

For furthermore comparison, a cover sheets 7-1 was prepared by the same method but substituting the copolymers I-3/II-2 employed in the cover sheet 1-1 by the following solution copolymer (9) described in U.S. Pat. No. 4,440,848.

(9) Vinyl acetate/vinyl benzoate/monovinyl adipate copolymer (52/34/14 (mol %)).

For furthermore comparison, a cover sheets 8-1 was prepared by the same method but substituting the layer (c) of the cover sheet 1-1 by the following layer (c'). (c') A neutralization timing layer containing 1.7 g/m$^2$ of a mixture (6/4 (by weight)) of a styrene/n-butyl acrylate/acrylic acid/N-methylolacrylamide copolymer latex (49.7/42.3/4.0/4.0 (% by weight)) with a methyl methacrylate/acrylic acid/N-methylolacrylamide copolymer latex (93.0/3.0/4/0 (% by weight)).

The neutralization timing time of each cover sheet was measured as follows.

Film with pH Indicator Coating:

On a transparent substrate of polyethylene terephthalte, an indicator layer containing 0.2 g/m$^2$ of thymolphthalein and 7.0 g/m$^2$ of gelatin was formed to give a film with pH indicator coating.

Alkali Processing Solution for Measuring Neutralization Timing Time:

0.8 g of an alkali processing solution of the following composition was packed into a container breakable under pressure:

| | |
|---|---|
| sodium salt of carboxymethyl cellulose | 58 g |
| potassium hydroxide (28% aqueous solution) | 200 cc |
| water | 830 cc |

Each of the transparent cover sheets was located opposite the film with pH indicator coating and the above-mentioned alkali processing solution for measuring neutralization timing time was developed between them at a solution thickness of 75 $\mu$m. Then the time required for halving the reflective density of the high pH color (blue) of the thymolphthalein was measured at 15° C. and 25° C.

The results are shown in Table 1 below.

TABLE 1

| | | Neutralization timing | | Temp. |
|---|---|---|---|---|
| | | time (min) | | compensation |
| | Cover sheet | 15° C. ($T_{15}$) | 25° C. ($T_{25}$) | $T_{15}/T_{25}$ |
| Invention | 1-1 | 12.4 | 4.1 | 3 |
| | 1-2 | 12 | 3.9 | 3.1 |
| | 1-3 | 11.5 | 3.7 | 3.1 |
| | 2-1 | 12.1 | 3.8 | 3.2 |
| | 2-2 | 12.6 | 4 | 3.2 |
| | 2-3 | 12.8 | 4.2 | 3 |

TABLE 1-continued

| | | Neutralization timing | | Temp. |
|---|---|---|---|---|
| | | time (min) | | compensation |
| | Cover sheet | 15° C. ($T_{15}$) | 25° C. ($T_{25}$) | $T_{15}/T_{25}$ |
| | 3-1 | 11.5 | 3.6 | 3.2 |
| | 3-2 | 12.2 | 3.7 | 3.3 |
| | 3-3 | 12.2 | 3.8 | 3.2 |
| | 3-4 | 11.8 | 3.8 | 3.1 |
| | 3-5 | 11.9 | 3.7 | 3.2 |
| | 3-6 | 12.2 | 3.9 | 3.1 |
| Comparison | 4-1 | 11 | 3.5 | 3.1 |
| | 4-2 | 13.2 | 4.3 | 3.1 |
| | 4-3 | 12 | 3.7 | 3.2 |
| | 4-4 | 11.5 | 3.8 | 3 |
| | 4-5 | 12.4 | 4 | 3.1 |
| | 5-1 | 12.5 | 3.9 | 3.2 |
| | 5-2 | 11.4 | 3.5 | 3.3 |
| | 5-3 | 11.2 | 3.7 | 3 |
| | 5-4 | 12.1 | 3.8 | 3.2 |
| | 5-5 | 11.6 | 3.7 | 3.1 |
| | 6-1 | 7.3 | 3.6 | 2 |
| | 6-2 | 9.1 | 4.4 | 2.1 |
| | 6-3 | 8.5 | 4 | 2.1 |
| | 7-1 | 12.1 | 4.1 | 2.9 |
| | 8-1 | 12.1 | 3.9 | 3.1 |

As the comparison of the data given in Table 1 clearly shows, the cover sheets of 1-1 to 1-3, 2-1 to 2-3 and 3-1 to 3-6 with the use of the copolymers of the present invention by solution polymerization are highly superior to the cover sheets 6-1 to 6-3 with the use of the copolymers obtained by solution polymerization and having the same capability of temperature compensating ($T_{15}/T_{25}$) of alkali permeability and comparable to the cover sheet 8-1 with the use of the latex. The cover sheets of 4-1 to 4-5, 5-1 to 5-5 and 7-1, although provided the temperature compensating capabilities which are not much different from those provided by the cover sheets according to the invention but, as demonstrated by the results of the comparative experiments in Example 2, caused larger changes during the neutralization timing time and/or had larger areas of adhesion trouble, thus being inferior as compared to the cover sheets of the invention.

EXAMPLE 2

Image Receiving Photosensitive Sheet:

The layered structure as shown below was formed on a transparent polyethylene terephthalate film substrate (thickness: 90 $\mu$m) to give a photosensitive sheet. The coated amounts of emulsions are silver basis.

Structure of photosensitive sheet

| Layer No. | Layer name | Additive | Amount (g/m$^2$) |
|---|---|---|---|
| 21 | Protective layer | Gelatin | 1.00 |
| | | Matting agent (1) | 0.25 |
| 20 | UV-absorption layer | Gelatin | 0.50 |
| | | UV absorber (1) | $4.0 \times 10^{-4}$ |
| | | UV absorber (2) | $4.0 \times 10^{-4}$ |
| 19 | Yellow-photo-sensitive layer (high sensitivity) | Direct positive emulsion of internal latent image type (octahedron 1.7 $\mu$m) | 0.60 |
| | | Sensitizing dye (3) | $1.4 \times 10^{-3}$ |
| | | Nucleating agent (1) | $6.8 \times 10^{-3}$ |
| | | Additive (2) | 0.03 |
| | | Gelatin | 0.70 |

-continued

Structure of photosensitive sheet

| Layer No. | Layer name | Additive | Amount (g/m$^2$) |
|---|---|---|---|
| 18 | Yellow-photo-sensitive layer (low sensitivity) | Direct positive emulsion of internal latent image type (octahedron 1.1 $\mu$m) | 0.25 |
| | | Sensitizing dye (3) | $9.0 \times 10^{-4}$ |
| | | Nucleating agent (1) | $8.0 \times 10^{-8}$ |
| | | Additive (2) | $4.5 \times 10^{-2}$ |
| | | Gelatin | 0.40 |
| 17 | Reflective layer | Titanium dioxide | 0.70 |
| | | Gelatin | 0.12 |
| 16 | Yellow color material layer | Yellow dye-releasing Compound (1) | 0.53 |
| | | High-boiling organic Solvent (1) | 0.13 |
| | | Additive (1) | $4.0 \times 10^{-2}$ |
| | | Gelatin | 0.70 |
| 15 | Intermediate layer | Gelatin | 0.30 |
| 14 | Color-mixing inhibiting layer | Additive (1) | 0.80 |
| | | Polymethyl methacrylate | 0.80 |
| | | Gelatin | 0.45 |
| 13 | Green-photo-sensitive layer (high sensitivity) | Direct positive emulsion of internal latent image type (octahedron 1.6 $\mu$m) | 0.80 |
| | | Sensitizing dye (2) | $2.1 \times 10^{-3}$ |
| | | Nucleating agent (1) | $2.5 \times 10^{-8}$ |
| | | Additive (2) | 0.90 |
| | | gelatin | 1.00 |
| 12 | Green-photo-sensitive layer (low sensitivity) | Direct positive emulsion of internal latent image type (octahedron 1.0 $\mu$m) | 0.25 |
| | | Sensitizing dye (2) | $1.1 \times 10^{-3}$ |
| | | Nucleating agent (1) | $4.4 \times 10^{-8}$ |
| | | Additive (2) | 0.03 |
| | | gelatin | 1.50 |
| 11 | Reflective layer | Titanium dioxide | 1.00 |
| | | Gelatin | 0.25 |
| 10 | Magenta color material layer | Magenta dye-releasing compound (1) | 0.50 |
| | | High-boiling organic solvent (1) | 0.10 |
| | | Additive (1) | $9.0 \times 10^{-3}$ |
| | | Gelatin | 0.90 |
| 9 | Intermediate layer | Gelatin | 0.30 |
| 8 | Color-mixing inhibiting layer | Additive (1) | 1.20 |
| | | Polymethyl methacrylate | 1.20 |
| | | Gelatin | 0.70 |
| 7 | Red-photo-sensitive layer (high sensitivity) | Direct positive emulsion of internal latent image type (octahedron 1.6 $\mu$m) | 0.50 |
| | | Sensitizing dye (1) | $6.2 \times 10^{-4}$ |
| | | Nucleating agent (1) | $5.0 \times 10^{-8}$ |
| | | Additive (2) | 0.04 |
| | | Gelatin | 0.80 |
| 6 | Red-photo-sensitive layer (low sensitivity) | Direct positive emulsion of internal latent image type (octahedron 1.0 $\mu$m) | 0.15 |
| | | Sensitizing dye (1) | $3.0 \times 10^{-4}$ |
| | | Nucleating agent (1) | $5.0 \times 10^{-8}$ |
| | | Additive (2) | 0.02 |
| | | Gelatin | 0.40 |
| 5 | Reflective layer | Titanium dioxide | 3.00 |
| | | Gelatin | 0.80 |
| 4 | Cyan color material layer | Cyan dye-releasing compound (1) | 0.50 |
| | | High-boiling organic solvent (1) | 0.10 |
| | | Additive (1) | 0.01 |
| | | Gelatin | 1.0 |

-continued

Structure of photosensitive sheet

| Layer No. | Layer name | Additive | Amount (g/m$^2$) |
|---|---|---|---|
| 3 | Opaque layer (light screening layer) | Carbon black | 1.70 |
| | | Gelatin | 1.70 |
| 2 | White reflective layer | Titanium dioxide | 22.00 |
| | | Gelatin | 2.75 |
| 1 | Image receiving layer | Polymer mordant (1) | 3.00 |
| | | Gelatin | 3.00 |

Substrate (polyethylene terephthalate 90 $\mu$m)

The chemical structural formulae, etc. of the compounds employed in the image receiving sheet are shown below.

Polymer mordant (1):

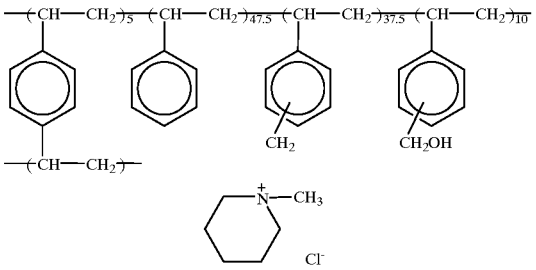

wherein each value assigned to repeating unit is % by weight.

UV absorber (1):

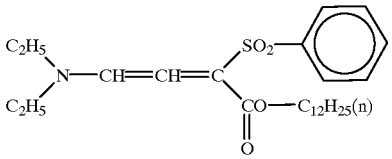

UV absorber (2):

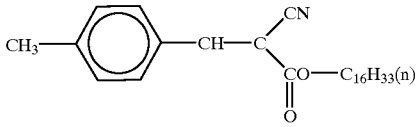

Matting agent (1):

Spherical latex of polymethylmethacrylate (average grain diameter: 4 $\mu$m)

Cyan dye-releasing compound (1):

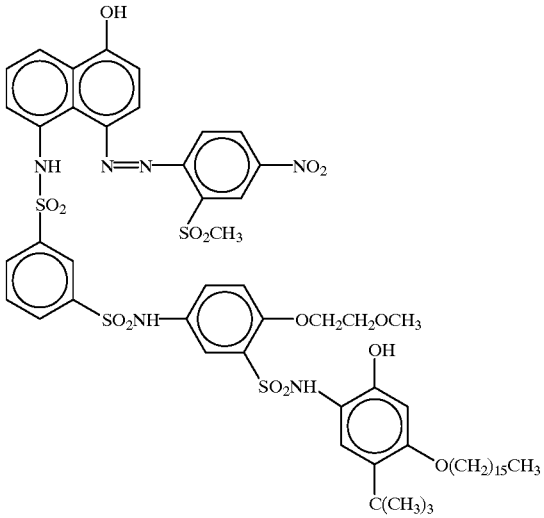

Magenta dye-releasing compound (1):

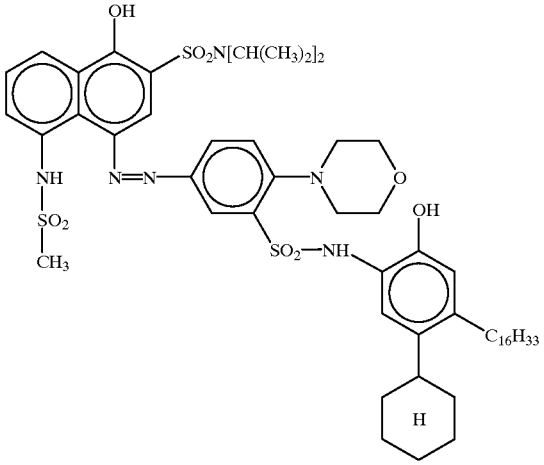

Yellow dye-releasing compound (1):

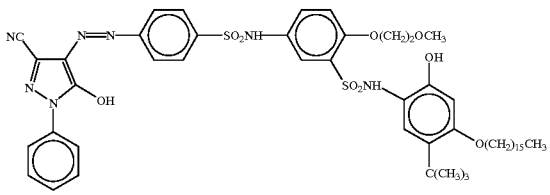

Additive (1): Additive (2):

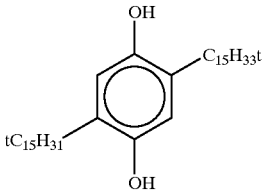

-continued

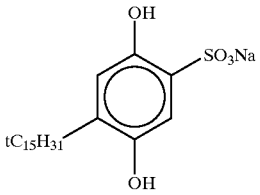

High-boiling organic solvent (1): Tricyclohexyl phosphate

Nucleating agent (1):

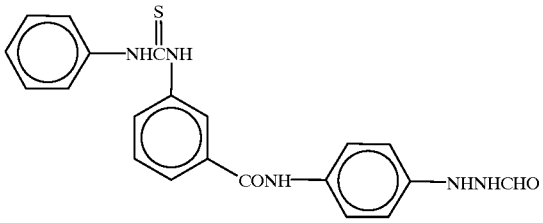

Sensitizing dye (1):

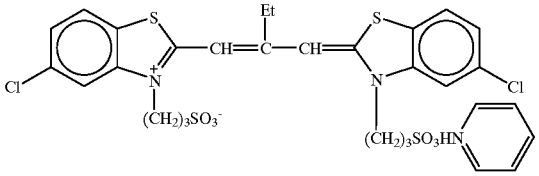

Sensitizing dye (2):

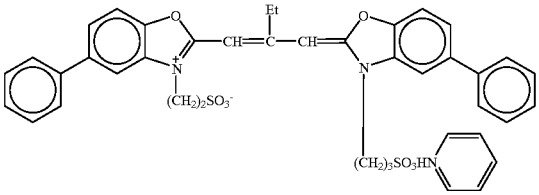

Sensitizing dye (3):

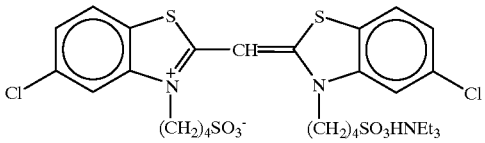

Alkali Processing Solution:

The composition of the alkali processing solution is given below.

| | |
|---|---|
| 1-p-Tolyl-4-hydroxymethyl-4-methyl-3-pyrazolidone | 10.0 g |
| Methylhydroquinone | 0.18 g |
| 5-Methylbenzotriazole | 3.0 g |
| Anhydrous sodium sulfite | 0.2 g |
| Benzyl alcohol | 1.5 cc |
| Sodium salt of carboxymethyl cellulose | 58 g |
| Carbon black | 150 g |

-continued

| | |
|---|---|
| Potassium hydroxide (28% aqueous solution) | 200 cc |
| Water | 680 cc. |

The processing solution of the above composition was packed into a container which is breakable by the application of pressure.

Test on Storage Stability with Time:

The cover sheets prepared in the above Example 1 and those stored at 50° C. under relative humidity of 80% for 3 days were each located opposite the above-mentioned film with pH indicator coating and the above-mentioned alkali processing solution for measuring neutralization timing time was developed between them at a solution thickness of 75 μm. Then the time required for halving the reflective density of the high pH color (blue) of the thymolphthalein was measured at 25° C.

Adhesion Resistance Test:

The cover sheets prepared in the above Example 1 and the above-mentioned image receiving photosensitive sheet were each stored in a thermostat at 40° C. under relative humidity of 80% so as to allow to absorb the moisture in the atmosphere until the equilibration was attained. Next, the coated face of each cover sheet was put on the coated face of the image receiving photosensitive sheet and allowed to stand under a load of 50 g/cm$^2$ for a day. Then the occurrence of adhesion trouble (% by area) was determined.

The results are shown in Table 2 below.

TABLE 2

| Cover sheet | Tg (° C.) | Neutralization timing time (min) Fresh | 50° C., 80% RH, 3 days | Change | Adhesion Trouble (% by area) |
|---|---|---|---|---|---|
| Invention | | | | | |
| 1-1 | 55 | 4 | 4.1 | 1.03 | 16 |
| 1-2 | 64 | 3.9 | 4.3 | 1.1 | 9 |
| 1-3 | 75 | 3.6 | 4.1 | 1.14 | 3 |
| 2-1 | 50 | 3.6 | 4 | 1.11 | 15 |
| 2-2 | 62 | 3.8 | 4.3 | 1.05 | 8 |
| 2-3 | 75 | 3.9 | 4.4 | 1.13 | 5 |
| 3-1 | 35 | 3.6 | 3.7 | 1.03 | 58 |
| 3-2 | 40 | 3.7 | 3.8 | 1.03 | 22 |
| 3-3 | 55 | 3.9 | 4.3 | 1.1 | 16 |
| 3-4 | 60 | 3.7 | 4.1 | 1.11 | 12 |
| 3-5 | 75 | 3.6 | 4 | 1.11 | 4 |
| 3-6 | 84 | 3.8 | 5 | 1.32 | 3 |
| Comparison | | | | | |
| 4-1 | 80 | 3.5 | 5.3 | 1.51 | 3 |
| 4-2 | 50 | 4.1 | 4.4 | 1.07 | 80 |
| 4-3 | 55 | 3.9 | 4.4 | 1.13 | 78 |
| 4-4 | 64 | 3.7 | 4.8 | 1.3 | 44 |
| 4-5 | 75 | 3.6 | 5.2 | 1.44 | 21 |
| 5-1 | 91 | 3.9 | 6.3 | 1.62 | 3 |
| 5-2 | 34 | 3.4 | 3.8 | 1.12 | 90 |
| 5-3 | 40 | 3.6 | 4 | 1.11 | 86 |
| 5-4 | 60 | 3.6 | 4.5 | 1.25 | 63 |
| 5-5 | 84 | 3.8 | 5.8 | 1.53 | 3 |
| 6-1 | 67 | 3.5 | 4.9 | 1.4 | 40 |
| 6-2 | 24 | 4.2 | 4.3 | 1.02 | 93 |
| 6-3 | 62 | 3.9 | 5.4 | 1.38 | 45 |
| 7-1 | | 4 | 6.1 | 1.53 | 85 |
| 8-1 | | 3.8 | 6.2 | 1.63 | 88 |

As the comparison of the data given in Table 1 clearly shows, the cover sheets of 1-1 to 1-3, 2-1 to 2-3 and 3-1 to 3-6 with the use of the copolymers of the present invention by solution polymerization are highly superior to other cover sheets in the storage stability with time and adhesion resistance. It is further found that the cover sheets having a Tg, after mixing, of from 40 to 75° C. achieve both high storage stability with time and good adhesion resistance. The superiority of the cover sheets having a Tg of from 40 to 75° C. becomes apparent by comparing with the cover sheet having a Tg out of this range, for example, the cover sheet of 3-1 having a Tg of less than 40° C., which provided an increased adhesion trouble area, and the cover sheet of 3-6 having a Tg exceeding 75° C., which provided an increased change during the neutralization timing time. Further, such an effect as described above can also be obtained by increasing the molecular weight of copolymer I-3 in the cover sheets according to the invention to the range of from 25,000 to 50,000.

While the invention has been described in detail and with reference to specific examples thereof, it will be apparent to one skilled in the art that various changes and modification can be made therein without departing from the spirit and scope thereof.

What is claimed is:

1. A photographic element which comprises a silver halide emulsion layer, an image receiving layer and at least one temporary barrier layer formed by applying an organic solvent solution containing at least two kinds of copolymers, wherein each of said at least two kinds of copolymers comprises, as its constituents, at least one monomer selected from group A, at least one monomer selected from group B, and at least one monomer selected from group C:

group A: mono(meth)acrylates of polyhydric alcohols;

group B: ethylenic unsaturated monomers having a carboxyl group; and group C: ethylenic unsaturated monomers which are other than those of groups A and B, and which are copolymerizable with the monomers of groups A and B, wherein said at least two kinds of copolymers include:

at least one copolymer having a glass transition temperature (Tg) of from not lower than 65° C. to not higher than 150° C.; and at least one copolymer having a Tg of from not lower than 0° C. to lower than 65° C.

2. The photographic element according to claim 1, wherein said at least two kinds of copolymers are mixed at a mixing ratio that gives a Tg of the mixture of from 40° C. to 75° C.

3. A diffusion transfer photographic element, which comprises a silver halide emulsion layer, an image receiving layer and at least one temporary barrier layer formed by applying an organic solvent solution containing at least two kinds of copolymers, wherein each of said at least two kinds of copolymers comprises, as its constituents, at least one monomer selected from group A, at least one monomer selected from group B, and at least one monomer selected from group C:

group A: mono(meth)acrylates of polyhydric alcohols;

group B: ethylenic unsaturated monomers having a carboxyl group; and group C: ethylenic unsaturated monomers which are other than those of groups A and B, and which are copolymerizable with the monomers of groups A and B, wherein said at least two kinds of copolymers include:

at least one copolymer having a glass transition temperature (Tg) of from not lower than 65° C. to not higher than 150° C.; and at least one copolymer having a Tg of from not lower than 0° C. to lower than 65° C.

4. The diffusion transfer photographic element according to claim 3, wherein said at least two kinds of copolymers are mixed at a mixing ratio that gives a Tg of the mixture of from 40° C. to 75° C.

* * * * *